United States Patent [19]

Ruckdeschel

[11] 4,111,151

[45] Sep. 5, 1978

[54] MULTI-PARTICLE DEVELOPABILITY REGULATING SYSTEM

[75] Inventor: Frederick R. Ruckdeschel, Webster, N.Y.

[73] Assignee: Xerox Corporation, Stamford, Conn.

[21] Appl. No.: 798,533

[22] Filed: May 19, 1977

[51] Int. Cl.[2] ..... B05C 11/00

[52] U.S. Cl. ..... 118/7; 118/646; 222/DIG. 1; 355/3 DD; 355/4; 355/14

[58] Field of Search ..... 355/14, 3 DD, 4; 222/DIG. 1; 118/7, 645, 646; 96/1.2; 356/206

[56] References Cited

U.S. PATENT DOCUMENTS

| | | | |
|---|---|---|---|
| 3,727,065 | 4/1973 | Maksymiak | 222/DIG. 1 |
| 3,777,173 | 12/1973 | Landrith | 222/DIG. 1 |
| 3,872,824 | 3/1975 | Erny et al. | 118/7 |
| 4,043,293 | 8/1977 | Ruckdeschel | 222/DIG. 1 |
| 4,065,031 | 12/1977 | Wiggins et al. | 222/DIG. 1 |

*Primary Examiner*—Richard L. Moses

*Attorney, Agent, or Firm*—J. J. Ralabate; C. A. Green; H. Fleischer

[57] ABSTRACT

An apparatus in which the developability of a development system comprising a mixture of particles having at least two different colors is regulated. The quantity of each of the differently colored particles is maintained at a pre-scribed level to form a mixture of particles having a pre-determined color.

20 Claims, 5 Drawing Figures

MULTI-PARTICLE DEVELOPABILITY REGULATING SYSTEM

BACKGROUND OF THE INVENTION

This invention relates generally to an electrophotographic printing machine, and more particularly concerns an apparatus for regulating the developability of a development system employed therein.

In the purpose of electrophotographic printing, a charged photoconductive member is exposed to a light image of an original document being reproduced. The irradiated areas of the photoconductive surface are discharged recording thereon an electrostatic latent image corresponding to the informational areas of the original document. A development system moves a developer mix of carrier granules and toner particles into contact with the photoconductive surface. The toner particles are attracted electrostatically from the carrier granules to the latent image forming thereon a toner powder image. Thereafter, the toner powder image is transferred to a sheet of support material. After transferring the toner powder image to the sheet of support material, a fusing device permanently affixes the toner powder image thereto.

It is evident that in a printing machine of this type, toner particles are depleted from the developer mixture. As the concentration of toner particles decreases, the density of the resultant copy degrades. In order to maintain the copies being reproduced at a specified minimum density, it is necessary to regulate the concentration of toner particles in the developer mixture. This is the function of the developability regulating apparatus.

With the advent of multi-color electrophotographic printing, it became highly desirable to mix toner particles of different colors in the developer mixture. In this manner, a mixture of differently colored toner particles produced a new color. For example, equal amounts of yellow and magenta toner particles when mixed together will produce a red color. Similarly, equal amounts of yellow and cyan toner particles will produce green, while equal amounts of magenta and cyan will produce blue. In a system of this type, it is necessary to control the concentration of at least two differently colored toner particles in the developer mixture. It is the function of the developability regulating apparatus to maintain the quantity of differently colored toner particles in the developer mixture at preselected levels so as to achieve the desired resultant color in the mixture. Variations in the quantity of one of the toner particles relative to the other toner particles will produce distortions in the color of the mixture.

Accordingly, it is a primary object of the present invention to improve the developability regulating system for controlling the concentration of a plurality of differently colored toner particles in the developer mixture.

PRIOR ART STATEMENT

Various types of devices have hereinbefore been developed to control the concentration of toner particles within a developer mixture so as to maintain the resultant image density at least at a minimum value. The following prior art appears to be relevant:

Kuhl et al U.S. Pat. No. 3,635,373 — 1972
Maksymiak U.S. Pat. No. 3,757,999 — 1973
Kamola U.S. Pat. No. 3,376,857 — 1968

Copending U.S. Pat. application Ser. No. 682,230, now U.S. Pat. No. 4,043,293 filed in 1976.

The pertinent portions of the foregoing prior art may be briefly summarized as follows:

Kuhl et al discloses a system employing two parallel spaced conductive plates through which the developer mixture flows. The plates are connected to a circuit wherein each is electrically charged alternately for equal periods of time to attract and repel toner particles. A light source is located on one side of the two plates with the photocell being located on the other side to sense the illumination intensity transmitted therethrough. The photocell develops an electrical signal which is processed to form an error signal. The error signal controls the dispensing of toner particles into the developer mix.

Maksymiak teaches the use of spaced conductive plates alternately electrically charged between which the developer mix flows. A light source is positioned on one side of the two plates and a photocell on the other side thereof. In this manner, the intensity of the light rays passing therethrough is detected. This system also provides a measurement of the toner particle concentration within the developer mix.

Kamola describes a toner concentration control system wherein two parallel spaced conductive plates define a channel through which developer mix passes. One plate has a pattern thereon which is held to an electrical potential to attract the toner particles from the developer mixture. A light source and photocell are positioned with the plates interposed therebetween. Another photocell is arranged as a leg of a wheatstone bridge circuit which includes the first photocell. In this way, an unbalance in the bridge circuit causes toner particles to be dispensed to the developer mixture.

Co-pending U.S. Patent application Ser. No. 682,230 describes a developability regulating apparatus comprising a transparent electrode which is electrically biased to attract toner particles from the carrier granules. Light rays are transmitted through the electrode and the intensity thereof is detected by a pair of photosensors. One photosensor has an optical filter interposed into the optical light path with a peak transmittance corresponding to the peak transmittance of the toner particles. The other photosensor has an optical filter interposed into the light path with a peak transmittance corresponding to the peak absorbance of the toner particles. The signals from the photosensors are processed and a control signal is developed which regulates the dispensing of additional toner particles into the developer mix.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for regulating the developability of a development system comprising a mixture of particles having at least two different colors.

Pursuant to the features of the invention, the apparatus includes transparent electrode means electrically biased to attract the mixture of particles thereto. Means illuminate the electrode means having the mixture of particles deposited thereon with light rays. Means are provided for sensing the intensity of the light rays transmitted through the mixture of particles adhering to the electrode means. The sensing means has peak transmittances at the wavelength of the peak transmittance of the resultant color formed by the mixture of differently colored particles, at the wavelength of the maximum transmittance ratio of the differently colored particles forming the mixture, and at the wavelength of the minimum transmittance ratio of the differently colored particles forming the mixture. The sensing means generates electrical signals indicating the mass of each of the differently colored particles in the mixture.

BRIEF DESCRIPTION OF THE DRAWINGS

Other objects and advantages of the present invention will become apparent upon reading the following detailed description and upon reference to the drawings, in which.

Figure 1:
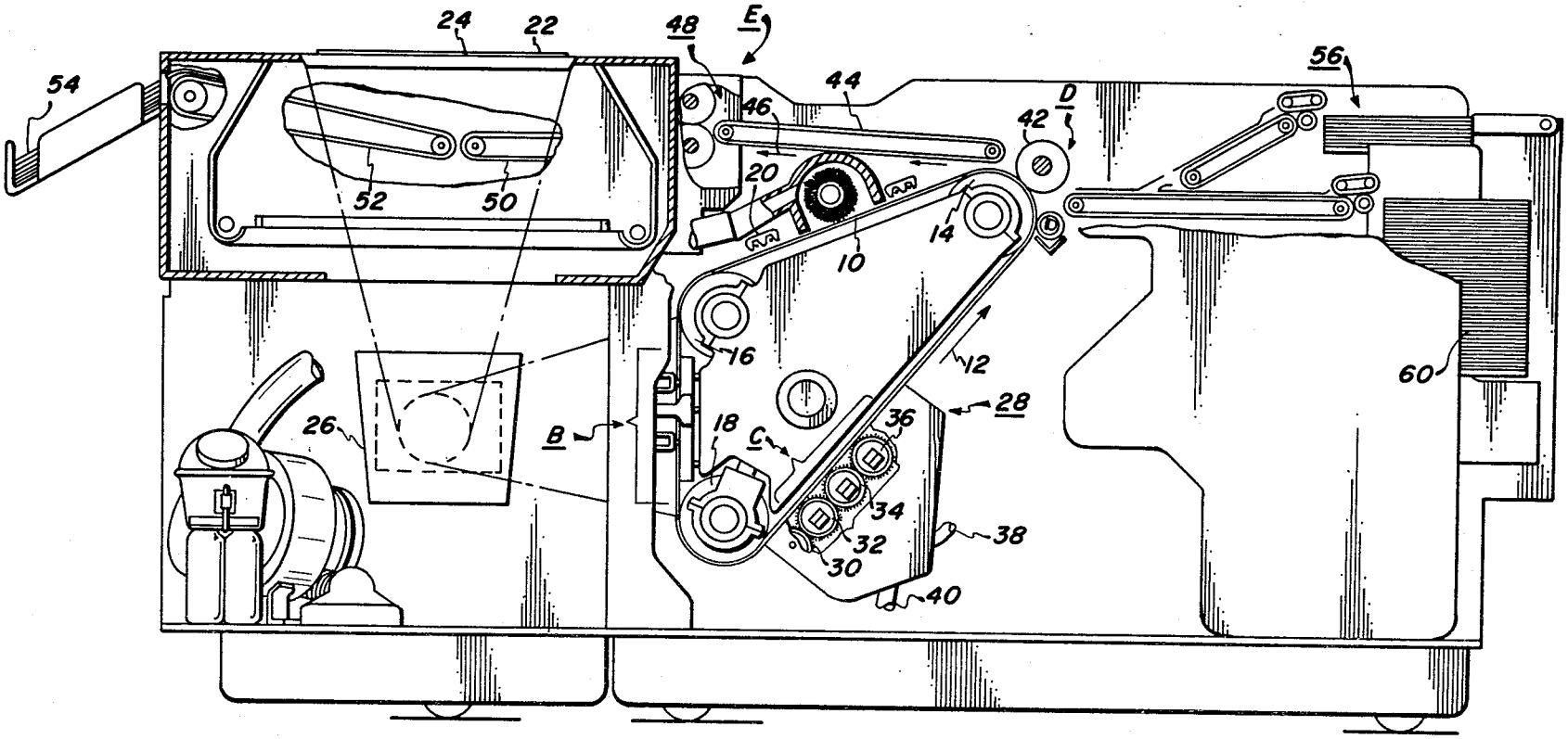
FIG. 1 is a schematic perspective view illustrating an electrophotographic printing machine embodying the features of the present invention therein.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the illustrative electrophotographic printing machine, in which the features of the present invention may be incorporated, reference is had to the drawings. In the drawings, like reference numerals have been used throughout to designate identical elements. Although the developability regulating apparatus of the present invention is particularly well adapted for use in the FIG. 1 printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine are only shown schematically and their operation described briefly with reference thereto.

As illustrated in FIG. 1, the electrophotographic printing machine employs a belt 10 having a photoconductive surface. By way of example, belt 10 may be made from a selenium alloy deposited on a conductive substrate, such as aluminum. Belt 10 moves in the direction of arrow 12 to advance sequentially through the various processing stations disposed about the path thereof. Rollers 14, 16 and 18 support belt 10. A drive mechanism, i.e. a suitable motor, is coupled to roller 14 so as to advance belt 10 in the direction of arrow 12.

Initially, a portion of belt 10 passes through charging station A. At charging station A, a corona generating device, indicated generally by the reference numeral 20, charges the photoconductive surface of belt 10 to a relatively high substantially uniform potential. A suitable corona generating device is described in U.S. Pat. No. 2,836,725 issued to Vyverberg in 1958.

Thereafter, the charged portion of belt 10 rotates through exposure station B. At exposure station B, an original document 22 is placed upon transparent platen 24 face down. An illumination system flashes light rays upon original document 22 to produce image rays corresponding to the informational areas contained therein. The image rays are projected by means of optical system 26 onto the charged portion of photoconductive belt 10. In this manner, the charged photoconductive surface of belt 10 is exposed to a light image of the original document. Exposure of the charged portion of the photoconductive surface to the light image discharges the charge thereon in accordance with the intensity of the light image projected thereto. In this way, an electrostatic latent image is recorded on the photoconductive surface of belt 10.

The electrostatic latent image recorded on belt 10 is advanced to development station C. At development station C, developer unit 28 has a plurality of magnetic brushes 30, 32, 34 and 36 disposed in housing 38 to move developer material adjacent to the electrostatic latent image recorded on belt 10. The developer mix comprises carrier granules having toner particles adhering thereto. Generally, the carrier granules are formed from a ferro-magnetic material while the toner particles are made from a heat settable plastic. In a typical magnetic brush system, a chain like array of developer mix extends in an outwardly direction from each magnetic brush to contact the electrostatic latent image recorded on the photoconductive surface. The latent image attracts electrostatically the toner particles from the carrier granules forming a toner powder image on belt 10. Developer unit 28 is adapted to deposit toner particles of a pre-selected color onto the electrostatic latent image recorded on belt 10. The toner particles are a mixture of at least two differently colored particles to achieve a pre-selected resultant color. For example, a mixture of equal amounts of yellow and magenta will produce red. A mixture of equal amounts of yellow and cyan produces green, while equal mixtures of magenta and cyan form blue.

In accordance with the features of the present invention, additional particles are added to the mixture so as to maintain the concentration of toner particles substantially constant, while the color remains unchanged. More particularly, the developability regulating system, located in housing 38, detects the concentration of each of the differently colored toner particles of the mixture and senses the additional amount of particles of each color required. At that time, an error signal is developed which controls dispensing of each of differently colored toner particles to the developer mixture. For example, the developer regulating apparatus senses the amount of each of the differently colored particles within the developer mix. An electrical output signal indicative of the detected amount of each of the particles is processed and error signals developed. These error signals control motors which oscillate toner cartridges to dispense additional toner particles into the developer mixture. The detailed structure and operation of the developability regulating apparatus will be described hereinafter in greater detail with reference to FIGS. 2 through 5, inclusive.

After development, the toner powder image is transported by belt 10 to transfer station D. Transfer station D is located at a point of tangency on belt 10 as it moves around roller 14. Roller 42 is disposed at transfer station D with the copy sheet being interposed between roller 42 and belt 10. Transfer roller 42 is electrically biased to a suitable magnitude and polarity so as to attract the toner powder image to the surface of the copy sheet in contact therewith. After transferring the toner powder image to the copy sheet, conveyer 44 advances the copy sheet in the direction of arrow 46 to fixing station E.

Fixing station E includes a fuser assembly, indicated generally by the reference numeral 48. Fuser assembly 48 has a heated fuser roll engaging a backup roll. The surface of the copy sheet having the toner powder image thereeon passes between the fuser roll and backup roll with the toner powder image contacting the fuser roll. In this manner, the toner powder image is permanently affixed to the copy sheet. After fusing, conveyers 50 and 52 advance the copy sheet to catch tray 54 for subsequent removal therefrom by the machine operator.

Referring now to the sheet feeding apparatus, sheet transport 56 advances, in seriatum, successive copy sheets from stack 58 or, in lieu thereof, stack 60. The machine programming permits the operator to select the desired stack from which the copy sheet will be advanced. In this way, the selected copy sheet is advanced to transfer station D where the toner powder image is transferred thereto.

It is believed that the foregoing description is sufficient for purposes of the present application to illustrate the general operation of an electrophotographic printing machine incorporating the features of the present invention therein. Referring now to the specific subject matter of the present invention, FIGS. 2 through 5, inclusive, depict the features of the developability regulating apparatus employed in the FIG. 1 printing machine.

Figure 2:
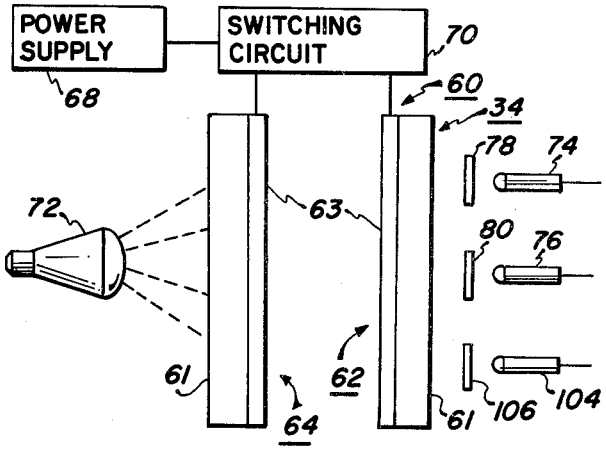
FIG. 2 is a schematic illustration of a developability regulating apparatus employed in the FIG. 1 printing machine.

Referring now to FIG. 2, the specific characteristics of the developability regulating apparatus employed in the FIG. 1 printing machine will be discussed hereinafter. Toner cartridges 100 and 102 (FIG. 5) are disposed in housing 38 of developer unit 28. Each cartridge holds toner particles of a pre-selected color with the color of the toner particles in cartridge 100 being different from the color of the toner particles in cartridge 102. For example, cartridge 100 may house yellow toner particles while cartridge 102 stores magenta particles. In this manner, the mix of toner particles in developer unit 28 will be red.

Each dispensing cartridge is cylindrical and includes perforations in the bottom portion thereof to meter therefrom a specified quantity of toner particles to developer unit 28 when oscillated. A suitable motor oscillates the dispensing cartridge to shear the toner particles contained therein and to dispense them through the perforations in the container to the corresponding developer mixture.

With continued reference to FIG. 2, developability regulating apparatus 34 comprises a transparent electrode assembly 60. Transparent electrode assembly 60 comprises a pair of parallel spaced-apart conductive plates 62 and 64. The plates define a passageway 66 through which the developer mixture flows. Plates 62 and 64 are identical to one another. By way of example, each plate is made from a substantially rectangular glass sheet 61 having a transparent tin oxide coating 63 thereon. This type of transparent, electrically conductive glass is made by Pittsburgh Plate Glass under the tradename NESA or is made by the Corning Glass Company under the tradename Electro-Conductive.

In operation, plates 62 and 64 have an electrical potential of a particular polarity impressed thereon to attract and retain toner particles. This potential is applied alternately to plates 62 and 64. As one of the plates is electrically charged to attract toner particles, the other has applied thereto a charge of a polarity which will repel toner particles therefrom during this time. As each of the plates are alternately charged positively and negatively, each plate, during a cycle, will attract toner particles for a short period of time and, then, immediately repel the same toner particles. During the second half of each cycle, wherein toner particles are repelled, the continuously flowing developer mixture moving between the plates will clean the particular plate having the repelling charge thereon.

Plates 62 and 64 are alternately electrically biased to a voltage of about 200 volts. This is achieved by voltage source or power supply 68 coupled to plates 62 and 64, respectively, through switching circuit 70. A suitable switching circuit and power supply arrangement for alternately electrically biasing each of the plates is described in U.S. Pat. No. 3,635,373 issued to Kuhl et al in 1972, the relevant portion thereof being hereby incorporated into the present application.

One skilled in the art will appreciate that it is not necessary to alternately switch the electrical bias on plates 62 and 64, but, in lieu thereof, one plate may be electrically biased to a suitable potential so as to attract toner particles thereto. In this mode of operation, the toner particles must be periodically cleaned from the plate.

Light source 72 illuminates plates 62 and 64. Preferably, light source 72 is a de-rated tungsten lamp with a regulated voltage, e.g., a 7 volt tungsten filament lamp operating from a 5 volt source. The light rays from light source 72 are transmitted through plates 62 and 64 and detected by photosensors 74, 76 and 104, respectively. Photosensors 74, 76 and 104 may be commercially available silicon phototransistors such as is produced by the General Electric Company, Model No. L114B. Optical filters 78, 80 and 106 are interposed between plate 62, photosensors 74, 76 and 104, respectively. The spectral characteristics of optical filters 78, 80 and 106 may be readily understood by referring to the graphs depicted in FIGS. 3 and 4.

Figure 3:
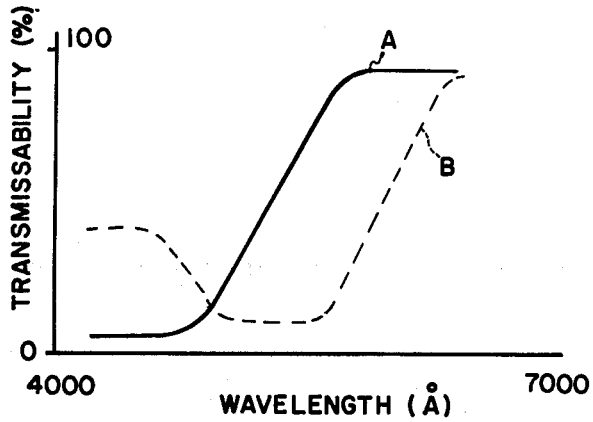
FIG. 3 is a graph depicting the transmissability of two exemplary differently colored particles employed in the mixture as a function of the wavelength.
Figure 4:
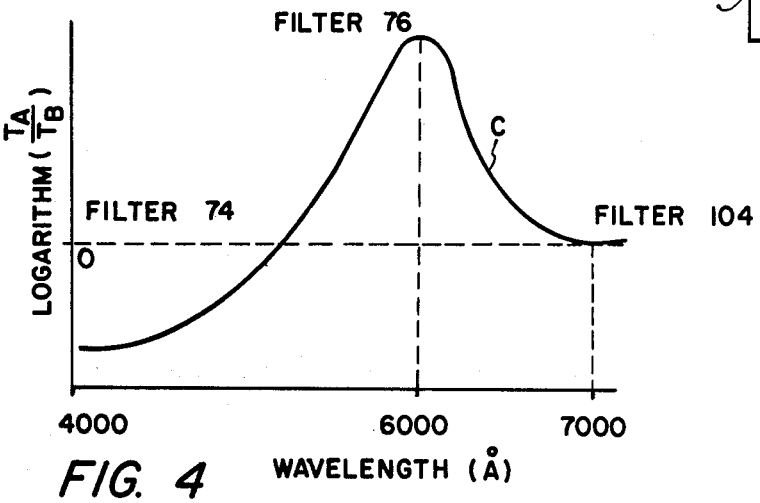
FIG. 4 is a graph showing the ratios of transmissabilities of the FIG. 2 particles as a function of wavelength.

Referring now to FIGS. 3 and 4, the two differently colored toner particles have transmissibilities, for a specified thickness, which vary with wavelength. As shown in FIG. 3, curve "A" is a graph of yellow toner particles as a function of transmissibility and wavelength. Similarly, curve "B" is a graph of magenta toner particles. The ratios of those transmissibilities as a function of wavelength is shown in FIG. 3 as curve "C". The mixture of differently colored toner particles has a pre-selected resultant color. For example, equal amounts of yellow toner particles and magenta toner particles will produce a red mixture. Thus, it is desirable to employ an optical filter having its peak transmittance in the spectral region of the desired color of the mixture of toner particles, i.e. in the red region. Hence, filter 104 has its peak transmittance at about 7000A. This insures a maximum signal for differentiating between the white light scattering of the toner particles and carrier granules and the color absorption of the toner particles. Filters 74 and 76 are chosen to insure a strong signal for differentiating between the absorptions of the differently colored toner particles. Thus, filter 74 has its peak transmittance at the wavelength of the minimum transmittance ratio of the differently colored particles, while filter 76 has its peak transmittance at the wavelength of the maximum transmittance ratio of the differently colored particles. Hence, in the preceeding example for yellow and magenta toner particles, optical filter 74 has its peak transmittance at about 4000A, while optical filter 76 has its peak transmittance at about 6000A. Thus, it is evident that three different optical bandpass filters are employed.

Assuming that light source 72 (FIG. 2) is a white light source and that the absorption process for transmission follows Beer's law in which the attenuation of light is proportional to $e^{-rm}$ where $r$ is the extinction coefficient and $m$ the mass/unit area. The transmission of light for a three component developer material, i.e. carrier and two differently colored toners, at a specified wavelength, will be the following:

$$T = A_w A_c A_1 A_2$$

where:

$T$ is the transmission of light;

$A_w$ is the white light scattering effect of the toner and carrier which reduces the transmitted white light intensity;

$A_c$ is the carrier absorption;

$A_1$ is the absorption of one toner; and $A_2$ is the absorption of the other toner.

In a reflectance system $A_w$ would be $R_w$, which increases the white light reflectance.

Applying Beer's law, the transmission of light is equal to:

$$T = A_w A_c e^{-r_1(\lambda)m_1} e^{-r_2(\lambda)m_2}$$

If measurements are made at each of the three filter wavelengths and assuming a non-selective neutral carrier, such as nickel berry or steel shot, $$T\lambda n = A_w A_c e^{-r_1(\lambda n)m_1} e^{-r_2(\lambda n)m_2}$$

Taking the natural logarithm of each equation, $$\ln T\lambda n = \ln (A_w A_c)^{-r_1(\lambda n)m_1 - r_2(\lambda n)m_2}$$

Thus, $$\ln T\lambda_1 - \ln T\lambda_2 = [r_1(\lambda_2) - r_1(\lambda_1)]\, m_1 + [r_2(\lambda_1) - r_2(\lambda_1)]\, m_2$$

and $$\ln T\lambda_2 - \ln T\lambda_3 = [r_1(\lambda_3) - r_1(\lambda_2)]\, m_1 + [r_2(\lambda_3) - r_2(\lambda_2)]\, m_2$$

Solving for the mass/unit area for each of the toner particles, $$m_1 = A_1 \ln T\lambda_1 + A_2 \ln T\lambda_2 + A_3 \ln T\lambda_3$$

and $$m_2 = B_1 \ln T\lambda_1 + B_2 \ln T\lambda_2 + B_2 \ln T\lambda_3$$

where $An$ and $Bn$ are predetermined constants.

The preceeding equations may be employed to control the dispensing of toner particles into the developer mixture. This is shown in FIG. 5.

Figure 5:
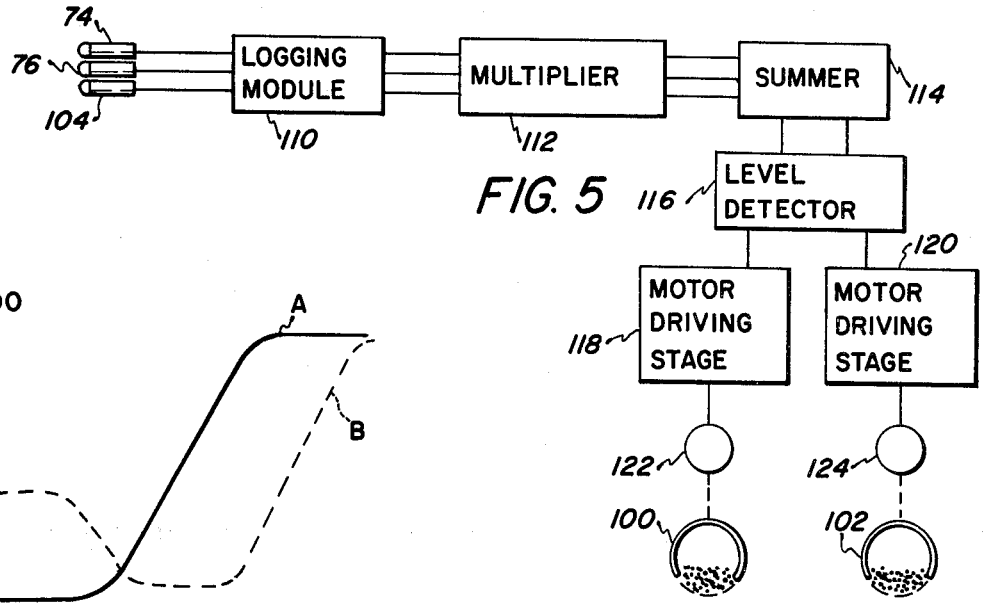
FIG. 5 is a block diagram depicting the control system used with the FIG. 2 developability regulating apparatus.

Referring now to FIG. 5, the electrical output signal from photosensors 74, 76 and 104 are processed by natural logging module 110. Diode function generators may be employed in logging module 110. Circuitry of this type is described in the Control Engineer's Handbook, published by the McGraw-Hill Book Company, Inc. in 1958 on pages 5–14 and 5–15 thereof, the relevant portions being hereby incorporated into the present application. The electrical output signals from logging module 110 correspond to $\ln T\lambda_1$, $\ln T\lambda_2$ and $\ln T\lambda_3$.

Multiplier 112 scales the electrical output signals from logging module 110. This is achieved by amplifying these signals through six amplifiers having the appropriate gain to generate six electrical signals, i.e. $A_1 \ln T\lambda_1$, $A_2 \ln T\lambda_2$, $A_3 \ln T\lambda_3$, $B_1 \ln T\lambda_1$, $B_2 \ln T\lambda_2$ and $B_2 \ln T\lambda_3$. Summer 114 combines these signals to generate a pair of electrical signals $m_1$ and $m_2$ corresponding to the mass per unit area.

The electrical output signals from summer 114 are processed by level detector 116. Level detector 116 preferably includes a suitable discriminator circuit for comparing a reference with each electrical output signal from summer 114. The discriminating circuit may utilize a silicon control switch which turns on and effectively locks in after an electrical output signal has been obtained having a magnitude greater than the reference level (i.e. set point). This signal from the discriminator circuit changes the state of a flip-flop to develop an output signal therefrom. The output signal from the flip-flop, in conjunction with an output signal from the developer unit actuates an AND gate which, in turn, transmits a control signal. The control signal also resets the flip-flop. The control signal from level detector 16 energizes motor driving stages 118 and 120 of the power supplies energizing motors 122 and 124, respectively. Motors 122 and 124, in turn, oscillate toner cartridges 100 and 102 to dispense toner particles through the perforations therein into developer unit 28. In this manner, the quantity of differently colored toner particles in the developer mixture in development unit 28 is adjusted to the desired level.

Hence, the developability regulating apparatus of the present invention develops signals indicative of the quantity of differently colored toner particles and controls these particle concentrations to pre-selected levels insuring that the mixture has the desired resultant color.

It is, therefore, apparent that there has been provided, in accordance with the present invention, an apparatus for regulating a plurality of differently colored toner particles to maintain a mixture thereof at a preselected color. The apparatus fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for regulating the developability of a development system comprising a mixture of particles having at least two different colors, including:

transparent electrode means electrically biased to attract a mixture of particles thereto;

means for illuminating said electrode means and the mixture of particles adhering thereto with light rays; and means for sensing the intensity of the light rays transmitted through the mixture of particles adhering to said electrode means, said sensing means having peak transmittances at the wavelength of the peak transmittance of the resultant color formed by the mixture of different colored particles, at the wavelength of the minimum transmittance ratio of the differently colored particles forming the mixture and at the wavelength of the maximum transmittance ratio of the differently colored particles forming the mixture, said sensing means generating electrical signals indicative of the mass of each of the differently colored particles in the mixture.

2. An apparatus as recited in claim 1, wherein said sensing means includes:

first means, having a peak transmittance at the wavelength of the resultant color formed by the mixture of the differently colored particles, for detecting the intensity of the light rays transmitted through the mixture of the particles adhering to said electrode means and generating a first electrical signal indicative thereof;

second means having the peak transmittance at the wavelength of the minimum transmittance ratio of the differently colored particles forming the mixture for detecting the intensity of the light rays transmitted through the mixture of particles adhering to said electrode means and generating a second electrical signal indicative thereof; and third means, having a peak transmittance at the wavelength of the maximum transmittance ratio of the differently colored particles forming the mixture, for detecting the intensity of the light rays transmitted through the mixture of particles adhering to said electrode means and generating a third electrical signal indicative thereof.

3. An apparatus as recited in claim 2, wherein said sensing means includes first circuit means for processing the first, second and third electrical output signals to determine the natural logarithm of each of the electrical output signals and scaling the logarithmic signals by pre-selected constants to form a plurality of electrical signals.

4. An apparatus as recited in claim 3, wherein said sensing means includes second circuit means for summing the electrical signals in a prescribed sequence to generate a first electrical signal corresponding to the mass of one of the particles of the mixture and a second electrical signal corresponding to the mass of the other of the particles of the mixture.

5. An apparatus as recited in claim 4, further including;

means for comparing the first electrical signal with a first reference and the second electrical signal with a second reference to produce a first control signal and a second control signal;

means, actuated by the first control signal, for dispensing one of the particles into the development system to achieve the requisite mass thereof; and means, actuated by the second control signal, for dispensing the other of the particles into the development system to achieve the requisite mass thereof.

6. An apparatus as recited in claim 2, wherein said electrode means includes:

a pair of spaced-apart conductive plates defining a passageway through which the mixture of particles flows; and means for electrically biasing at least one of said pair of plates.

7. An apparatus as recited in claim 6, wherein said biasing means produces cyclically an electrical charge on first one then the other of said pair of plates capable of attracting the mixture of particles thereto so that the particles are attracted to one of said pair of plates, and, substantially simultaneously therewith, released from the other of said pair of plates.

8. An apparatus as recited in claim 2, wherein said first detecting means includes:

a first photosensor positioned in a light receiving relationship with the light rays transmitted through said electrode means; and a first optical filter interposed in the path of the light rays transmitted to said first photosensor, said first optical filter having a peak transmittance at the wavelength of the resultant color formed by the mixture of differently colored particles.

9. An apparatus as recited in claim 8, wherein said second detecting means includes:

a second photosensor positioned in a light receiving relationship with the light rays transmitted through said electrode means; and a second optical filter interposed in the path of the light rays transmitted to said second photosensor, said second optical filter having a peak transmittance at the wavelength of the minimum transmittance ratio of the differently colored particles forming the mixture.

10. An apparatus as recited in claim 9, wherein said third detecting means includes:

a third photosensor positioned in a light receiving relationship with the light rays transmitted through said electrode means; and a third optical filter interposed in the path of the light rays transmitted to said third photosensor, said third optical filter having a peak transmitance at the wavelength of the maximum transmittance ratio of the differently colored particles forming the mixture.

11. An electrophotographic printing machine of the type having a development system comprising a mixture of particles having at least two different colors with the quantity of each of the particles therein being regulated, wherein the improvement includes:

transparent electrode means electrically biased to attract the mixture of particles thereto;

means for illuminating said electrode means and the mixture of particles adhering thereto with light rays; and means for sensing the intensity of the light rays transmitted through the mixture of particles adhering to said electrode means, said sensing means having peak transmittances at the wavelength of the peak transmittance of the resultant color formed by the mixture of differently colored particles, at the wavelength of the minimum transmittance ratio of the differently colored particles forming the mixture, and at the wavelength of the maximum transmittance ratio of the differently colored particles forming the mixture, said sensing means generating an electrical signal indicative of the mass of each of the differently colored particles in the mixture.

12. A printing machine as recited in claim 11, wherein said sensing means includes:

first means, having a peak transmittance at the wavelength of the resultant color formed by the mixture of differently colored particles, for detecting the intensity of the light rays transmitted through the mixture of particles adhering to said electrode means and generating a first electrical signal indicative thereof;

second means, having a peak transmittance at the wavelength of the minimum transmittance ratio of the differently colored particles forming the mixture, for detecting the intensity of the light rays transmitted through the mixture of particles adhering to said electrode means and generating a second electrical signal indicative thereof; and third means, having a peak transmittance at the wavelength of the maximum transmittance ratio of the differently colored particles forming the mixture, for detecting the intensity of the light rays transmitted through the mixture of particles adhering to said electrode means and generating a third electrical signal indicative thereof.

13. A printing machine as recited in claim 12, wherein said sensing means includes circuit means for processing the first, second and third electrical output signals to determine the natural logarithm of each of the electrical output signals and scaling the logarithmic signals by pre-selected constants to form a plurality of electrical signals.

14. A printing machine as recited in claim 13, wherein said sensing means includes second circuit means for summing the electrical signals in a pre-scribed sequence to generate a first electrical signal corresponding to the mass of one of the particles of the mixture and a second electrical signal corresponding to the mass of the other of the particles of the mixture.

15. A printing machine as recited in claim 14, further including:

means for comparing the first electrical signal with a first reference and a second electrical signal with a second reference to produce a first control signal and a second control signal;

means, actuated by the first control signal, for dispensing one of the particles into the development system to achieve the requisite mass thereof; and means, actuated by the second control signal, for dispensing the other of the particles into the development system to achieve the requisite mass thereof.

16. A printing machine as recited in claim 12, wherein said electrode means includes:

a pair of spaced-apart conductive plates defining a passageway through which the mixture of particles flows; and means for electrically biasing at least one of said pair of plates.

17. A printing machine as recited in claim 16, wherein said biasing means produces cyclically an electrical charge on first one then the other of said pair of plates capable of attracting the mixture of particles thereto so that the particles are attracted to one of said pair of plates and, substantially simultaneously therewith, released from the other of said pair of plates.

18. A printing machine as recited in claim 12, wherein said first detecting means includes:

a first photosensor positioned in a light receiving relationship with the light rays transmitted through said electrode means; and a first optical filter interposed into the path of the light rays transmitted to said first photosensor, said first optical filter having a peak transmittance at the wavelength of the resultant color formed by the mixture of differently colored particles.

19. A printing machine as recited in claim 18, wherein said second detecting means includes:

a second photosensor positioned in a light receiving relationship with the light rays transmitted through said electrode means; and a second optical filter interposed in the path of the light rays transmitted to said photosensor, said second optical filter having a peak transmittance at the wavelength of the minimum transmittance ratio of the differently colored particles forming the mixture.

20. A printing machine as recited in claim 19, wherein said third detecting means includes:

a third photosensor positioned in a light receiving relationship with the light rays transmitted through said electrode means; and a third optical filter interposed in the path of the light rays transmitted to said third photosensor, said third optical filter having a peak transmittance at the wavelength of the maximum transmittance ratio of the differently colored particles forming the mixture.

* * * * *